United States Patent [19]

Bodin

[11] 4,328,597

[45] May 11, 1982

[54] ADJUSTABLE WASH-BASIN

[75] Inventor: Boris G. R. Bodin, Bromölla, Sweden

[73] Assignee: Ifö Sanitär AB, Bromölla, Sweden

[21] Appl. No.: 183,629

[22] Filed: Sep. 3, 1980

[30] Foreign Application Priority Data

Sep. 14, 1979 [SE] Sweden ..... 7907650

[51] Int. Cl.[3] ..... A47K 1/05; E03C 1/32

[52] U.S. Cl. ..... 4/644; 4/645; 4/312

[58] Field of Search ..... 4/644, 643, 645, 646, 4/619, 312

[56] References Cited

U.S. PATENT DOCUMENTS

| | | | |
|---|---|---|---|
| 599,706 | 3/1898 | Heineken | 4/644 |
| 1,067,261 | 7/1913 | Legge | 4/644 |
| 1,102,123 | 6/1914 | Asztalos | 4/644 |
| 1,305,624 | 6/1919 | Schneider et al. | 4/644 |
| 1,480,145 | 1/1924 | Berven | 4/627 |

*Primary Examiner*—Henry K. Artis

*Attorney, Agent, or Firm*—Frishauf, Holtz, Goodman and Woodward

[57] ABSTRACT

A wall-mounted wash-basin is supported by a mechanism which permits adjustment of the vertical position of the wash-basin by movement around a horizontal axis parallel with the wall. According to the invention the wash-basin is tiltable between an upper position, where the top surface of the basin is at least substantially horizontal and the bottom of the basin is inclined from the user downwardly towards the wall, and a lower position in which the basin bottom is substantially horizontal.

4 Claims, 2 Drawing Figures

ADJUSTABLE WASH-BASIN

BACKGROUND OF THE INVENTION

The present invention relates to a wash-basin the vertical position of which is adjustable. Wash-basins are normally mounted on a wall at a height over the floor which suits adults of normal tallness. This means that it is extremely difficult, and often completely impossible, for disabled persons sitting in wheel-chairs without any assistance to use such a wash-basin.

It does per se belong to the prior art to provide a wash-basin with means making its height adjustable. However, the prior art devices are either very complicated and thus expensive to install and to service or are provided with bulky adjustment mechanisms which to such an extent obstruct the approach of a wheel-chair that the basin cannot be used by individuals sitting in such chairs. As examples of installations of these two prior art types, reference is made to U.S. Pat. No. 3,486,175 and to German Auslegeschrift 2 819 428, respectively.

SUMMARY OF THE INVENTION

The object of the present invention is to provide a height-adjustable wash-basin which does not suffer from the above-mentioned limitations or complications, so that it provides a realistic solution to the problem of offering a wash-basin which may conveniently be used both by standing grown up individuals and by a disabled person sitting in a wheel-chair. The basic inventive idea is that the basin is tiltable rather than vertically displaceable. A second significant feature of the present invention is that the bottom of the basin has such a configuration that an adequate amount of water will be retained therein both in the normal and in the tilted position thereof.

DETAILED DESCRIPTION

Figure 1:
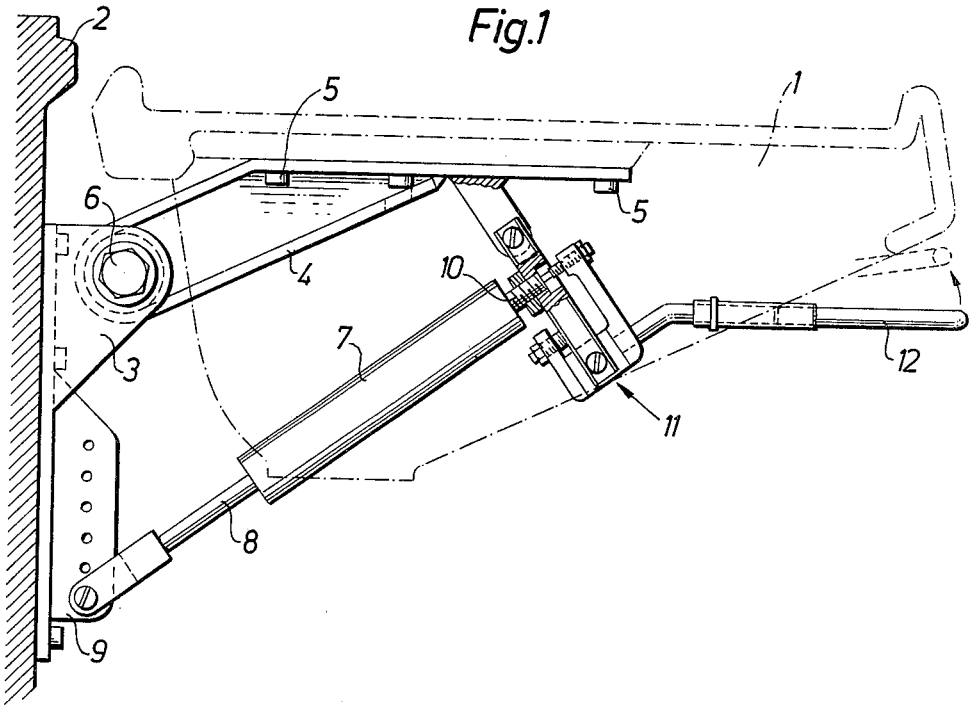
FIG. 1 is a side elevational view showing an embodiment of the basin of the present invention in its normal, horizontal position drawn in phantom lines, and also illustrating suitable mounting means.

The basin 1 is mounted on a wall 2. The basin has a free end remote from the wall, the free end being closest to a user of the basin. The mounting means, according to exemplary embodiments illustrated comprises two brackets 3 supporting a horizontal shaft 6. The horizontal shaft 6 supports two mounting arms 4, one at each side of the basin, secured to the basin by means of bolts 5. Bracket 3 has a lower extension 9 to which there is swingably on pinotally mounted the lower end of a pneumatic spring having a cylinder 7, a piston rod 8 and a control rod 10. A link mechanism 11 is provided so as to transform a vertical swinging movement of a handle 12 into a rotational movement of control rod 10 of the pneumatic spring. It should be observed that the specific components 7–12 do not form any part of the subject of the present invention. First, they per se belong to the art and, second, they just represent one suitable way of controlling the tilting movement of the basin. Any suitable equivalent arrangement can be used.

Figure 2:
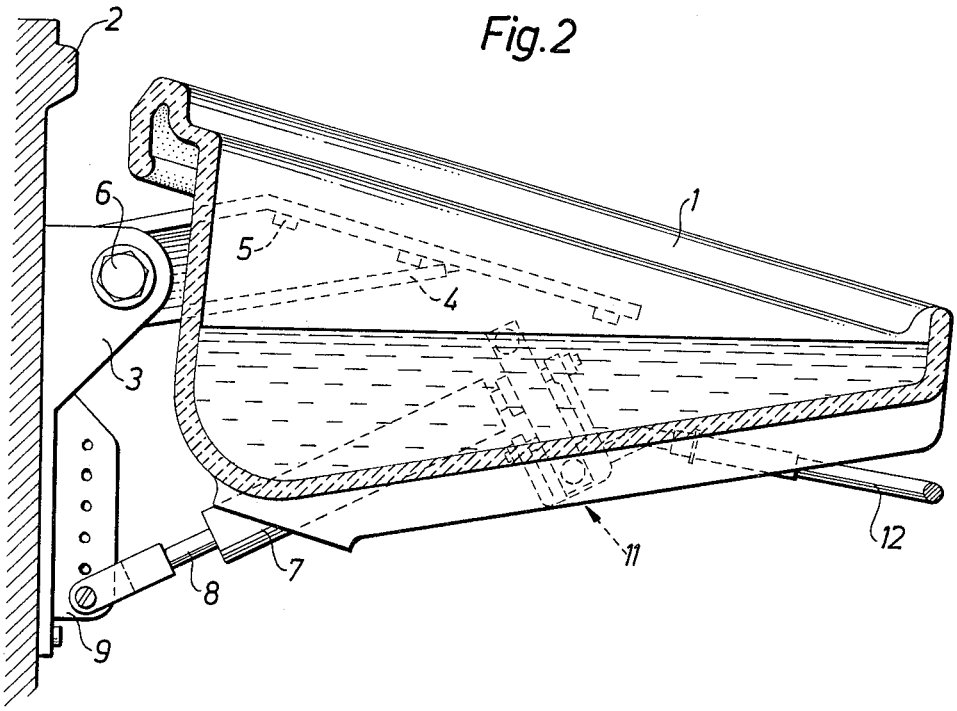
FIG. 2 is a side elevational view with basin shown in section and in a tilted position.

As appears most clearly from FIG. 2, the bottom of the basin 1 is shaped so that when the basin is in its tilted position the bottom is substantially horizontal. This means that an adequate amount of water will be retained in the basin irrespective of whether it is in its normal horizontal position shown in FIG. 1 or tilted as shown in FIG. 2.

It should also be observed that all components supporting the wash-basin 1 are within the contour thereof, meaning that a wheel-chair can be positioned very far in under the basin. the basin itself or its supporting components will not obstruct such a position and, as a matter of fact, the inward movement of a wheel-chair will not be halted until the foot-rest of the chair comes into contact with wall 2. This makes it possible for a disabled person to place himself in such a position that he can conveniently use the basin when it is tilted as shown in FIG. 2 and he is still sitting in his wheel-chair.

Finally, it is to be noted that while in the present embodiment the basin swings around a shaft 6, it is not necessary that the swinging axis be a tangible shaft. The only requirement is that the arrangement permit a swinging movement around a horizontal axis. As is understood, the overall arrangement according to the present invention is completely different from those prior art devices which likewise comprise horizontal shafts supporting link arms but where those arms from a parallel link mechanism so that the swinging movement of the arms results in a translatory vertical displacement of the wash-basin.

What is claimed is:

1. A wash-basin arrangement in which the vertical position of a basin is adjustable, comprising:

a basin having an inclined basin bottom and side walls generally upwardly extending from said inclined bottom;

means for mounting the basin on a wall and supporting the basin, said basin having a free end remote from the wall, said mounting means including means for pivotally mounting the basin around a horizontal line substantially parallel with the wall for permitting adjustment of the vertical position of the basin by movement around said horizontal line;

said inclined basin bottom being inclined downwardly from said free end of said basin towards the wall on which said basin is mounted so as to define a depressed area closest to said wall for retaining an adequate amount of water therein for use;

said mounting means further including means for tilting the basin around said horizontal line between an upper operable position of the basin where the top surface defined by the upper edges of said side walls of the basin is substantially horizontal and the bottom of the basin is inclined downwardly from said free end thereof towards the wall, and a lower, downwardly pivoted, operable position of the basin in which the normally inclined basin bottom is substantially horizontal and said top surface of the basin is downwardly inclined from the wall to said free end of said basin, said adequate amount of water being retained in said basin even when it is inclined downwardly to said lower position; and said tilting means including a handle extending substantially to the free end of said basin for actuating said tilting means, said handle being operable by a seated person to pivot said basin between said upper substantially horizontal operable position and said lower downwardly inclined operable position.

2. The wash-basin arrangement of claim 1 wherein said mounting means comprises means at the opposite sides of said basin for pivotally mounting the basin to the wall.

3. The wash-basin arrangement of claim 1 or 2 wherein said mounting means comprises a horizontal shaft defining said horizontal line.

4. The wash-basin arrangement of claim 1 wherein said mounting and tilting means are arranged substantially within the contour of the basin to provide a substantially free space below the basin for access by, for example, a wheel-chair.

* * * * *